US011485390B2

(12) United States Patent
Blum et al.

(10) Patent No.: US 11,485,390 B2
(45) Date of Patent: Nov. 1, 2022

(54) LIFTABLE CARRYING DEVICE

(71) Applicants: Kaessbohrer Transport Technik GmbH, Eugendorf (AT); Franz Blum, Salzburg (AT)

(72) Inventors: Franz Blum, Salzburg (AT); Horst Foessl, Elsbethen (AT)

(73) Assignee: KAESSBOHRER TRANSPORT TECHNIK GMBH, Eugendorf (AT)

( * ) Notice: Subject to any disclaimer, the term of this patent is extended or adjusted under 35 U.S.C. 154(b) by 626 days.

(21) Appl. No.: 16/523,348

(22) Filed: Jul. 26, 2019

(65) Prior Publication Data

US 2020/0039538 A1 Feb. 6, 2020

(30) Foreign Application Priority Data

Aug. 3, 2018 (EP) ..... 18187297

(51) Int. Cl.
*B61D 47/00* (2006.01)
*B61D 3/20* (2006.01)
(Continued)

(52) U.S. Cl.
CPC ..... *B61D 47/005* (2013.01); *B61D 3/00* (2013.01); *B61D 3/184* (2013.01); *B61D 3/20* (2013.01); *B61D 47/00* (2013.01)

(58) Field of Classification Search
CPC ... B61D 1/00; B61D 3/00; B61D 3/04; B61D 3/08; B61D 3/16; B61D 3/166;
(Continued)

(56) References Cited

U.S. PATENT DOCUMENTS 6,447,226 B1 * 9/2002 Andre ..... B60P 1/43 410/24
6,705,825 B2 * 3/2004 Kreutinger ..... B60P 1/4492 414/556
(Continued)

FOREIGN PATENT DOCUMENTS

CN 103978986 8/2014
CN 204250051 4/2015
(Continued)

OTHER PUBLICATIONS

Search Report dated Feb. 5, 2019 in European Application No. 18 18 7297.
(Continued)

*Primary Examiner* — Zachary L Kuhfuss
*Assistant Examiner* — Cheng Lin
(74) *Attorney, Agent, or Firm* — Wenderoth, Lind & Ponack, L.L.P.

(57) ABSTRACT

A liftable carrying apparatus includes a carrying frame having at least two longitudinal beams extending relative to each other and connected with each other. The carrying frame has, a first support for the cargo, which first support can be driven on up to a maximum width transversely relative to the at least two longitudinal beams. A receiving location is provided for the lifting apparatus, and contact surfaces are provided for direct placement of the carrying apparatus on a terminal floor. A second support is arranged at or between arms of a first support device. A length of the arms is selected so that the first support in a first pivotal position of the arms is prolonged by the second in such a way that it can be driven on and that the second support is raised in a second pivotal position of the arms relative to the first support.

20 Claims, 20 Drawing Sheets

Figure 1A:
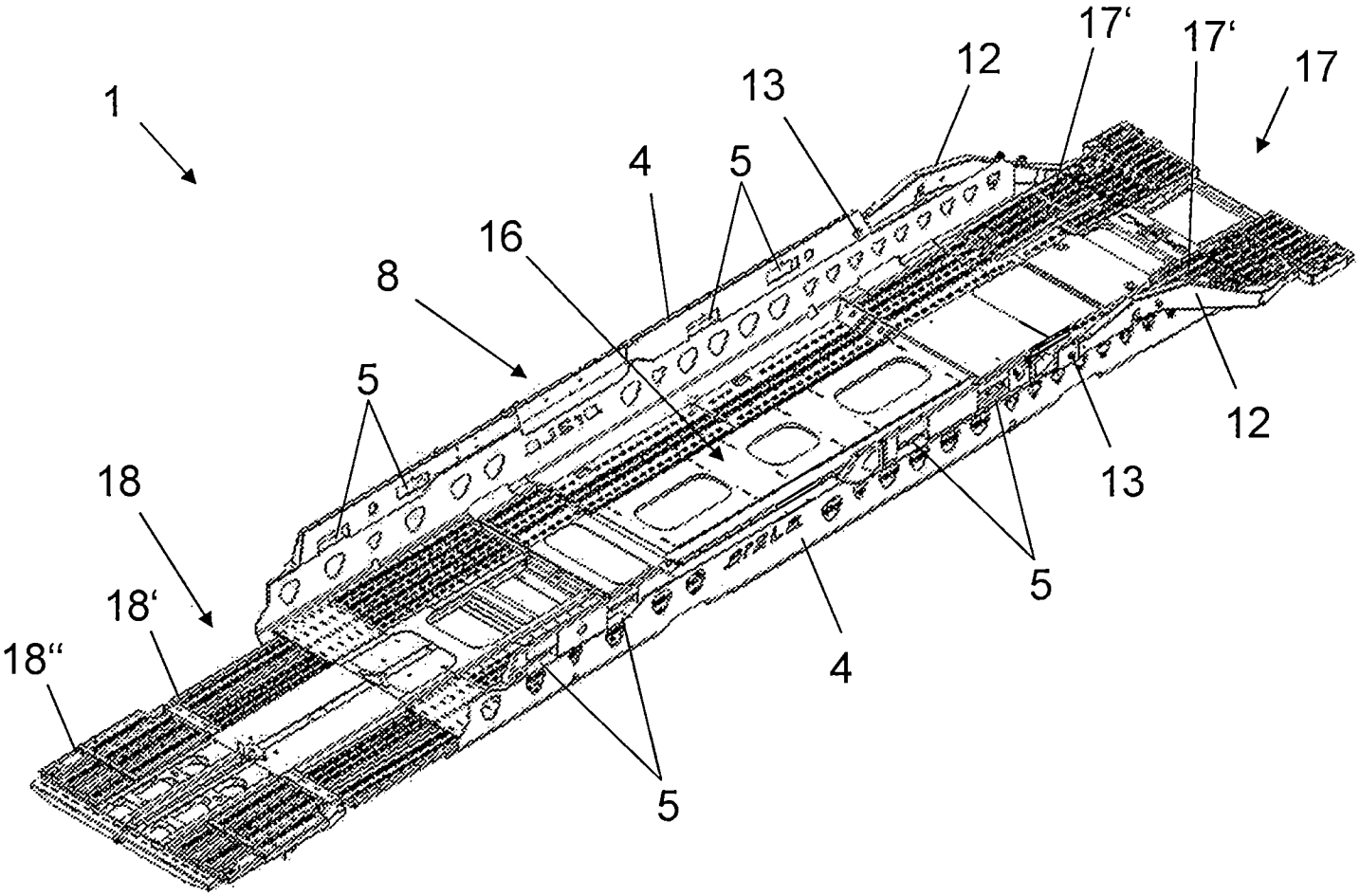

(51) Int. Cl.
*B61D 3/00* (2006.01)
*B61D 3/18* (2006.01)

(58) Field of Classification Search
CPC ..... B61D 3/18; B61D 3/181; B61D 3/182; B61D 3/184; B61D 3/20; B61D 47/00; B61D 47/005; B61D 49/00; B65D 2585/6867; B60P 1/003; B60P 1/16; B60P 1/162; B60P 1/165; B60P 1/167; B60P 1/43; B60P 1/431; B60P 1/433; B60P 1/435; B60P 1/436; B60P 1/438; B60P 1/4407–4492; B60P 1/48; B60P 1/483; B60P 1/486; B60P 1/50
See application file for complete search history.

(56) References Cited

U.S. PATENT DOCUMENTS

| | | | | |
|---|---|---|---|---|
| 7,033,128 | B2 * | 4/2006 | Poindexter | B60P 1/4414 414/544 |
| 8,533,884 | B1 * | 9/2013 | Johnson | A61G 3/067 14/71.3 |
| 9,597,240 | B2 * | 3/2017 | Hermanson | B60P 1/435 |
| 10,583,847 | B2 * | 3/2020 | Blum | B61D 3/04 |
| 2018/0009359 | A1 * | 1/2018 | Garneau | B60P 1/4471 |
| 2018/0009451 | A1 | 1/2018 | Blum et al. | |

FOREIGN PATENT DOCUMENTS

| | | |
|---|---|---|
| CN | 107667049 | 2/2018 |
| DE | 1 906 056 | 12/1964 |
| DE | 1 455 318 | 2/1969 |
| FR | 1 472 098 | 3/1967 |
| GB | 1043776 | 9/1966 |
| WO | 2016/141399 | 9/2016 |

OTHER PUBLICATIONS

English machine translation of description and claims of Korean Application No. 20030018002 published Mar. 4, 2003.

* cited by examiner

LIFTABLE CARRYING DEVICE

The invention concerns a liftable carrying apparatus having the features of the classifying portion of claim 1, and a rail vehicle, in particular a pocket wagon, having such a carrying apparatus.

A carrying apparatus of the general kind set forth is disclosed in WO 2016/141399 A1.

Cargo which itself does not have to be directly cranable can be loaded in many different forms with such a carrying apparatus as the carrying apparatus itself is cranable. The cargo can be for example vehicles (for example semitrailers, traction units, tractors, buses) or non-drivable cargo (for example containers).

In the present disclosure the term receiving position is used to denote that position of the at least one support device, in which loading or unloading of the carrying apparatus is effected. In the receiving position the at least one support device is oriented substantially horizontally and after loading with cargo the cargo is accordingly also oriented substantially horizontally. The term loading position is used to denote that position of the at least one support device in which the cargo, after the end of the loading operation, is disposed jointly with the carrying apparatus on the rail vehicle. In the loading position the vehicle can be oriented horizontally or inclinedly depending on the respective configuration of the support means.

In the case of the carrying apparatus of the general kind set forth a part of the load space between the longitudinal beams is occupied by the first support device.

The object of the invention is to provide a carrying apparatus of the general kind set forth and a rail vehicle, in particular a pocket wagon, having such a carrying apparatus, in which an increased load space is available.

That object is attained by a carrying apparatus having the features of claim 1 and a rail vehicle, in particular a pocket wagon, having such a carrying apparatus. Advantageous configurations of the invention are recited in the appendant claims.

The invention firstly concerns a liftable carrying apparatus for loading a rail vehicle with cargo by a lifting apparatus. The carrying apparatus has a carrying frame which in turn has at least two longitudinal beams which extend relative to each other with mutually facing insides and which are connected with each other. The longitudinal beams of the carrying frame can be at least portion-wise flat and/or profiled—for example of a substantially rectangular cross-sectional profile.

The carrying frame at least over a part of the length of the at least two beams, has a first support means for the cargo, which can be driven on up to a maximum width transversely relative to the at least two longitudinal beams. The longitudinal beams can be connected with each other by way of the first support means which can be driven on. The first support means can be arranged at an end of the longitudinal beams, which is the lower end in the vertical direction.

The carrying frame further has at least one receiving location, in particular receiving pocket, for the lifting apparatus. The receiving pockets are preferably adapted for gripping edges of a so-called "spreader" which can be mounted to a crane or a so-called "reach stacker". Particularly preferably the receiving pockets are arranged in an upper end region of the carrying frame.

By virtue of the fact that a first support device for the cargo has arms, at or between which at least one second support means for the cargo is arranged, the spacing of the pivot axis, about which the first support device is pivotable relative to the longitudinal beams of the carrying frame, can be selected relative to the second support means substantially independently of the dimensions of the second support means. In addition the path which is described by the second support means upon pivotal movement can be influenced thereby. The arms can extend substantially straight at least portion-wise. The arms can be at least portion-wise of a flat and/or profiled configuration—for example of a substantially rectangular cross-sectional profile. The second support means can be arranged on the arms at an angle. By virtue thereof it is possible for example to establish the orientation of the second support means relative to the first support means for a given pivotal position of the arms.

Because the arms are arranged outside the width which can be driven on of the first support means for the cargo on pivot bearings the continuous internal width between the longitudinal beams of the carrying frame, that is basically made possible by virtue of the width of the first support means, is not reduced by the arms.

The longitudinal beams of the carrying frame can be spaced from each other to such an extent that the carrying apparatus can be loaded without any problem with vehicles (for example semitrailers, traction units, tractors, buses) or with non-drivable cargo (for example containers). Preferably the internal width which is continuous (along the longitudinal extent) between the two longitudinal beams of the carrying frame—therefore for example the possible drivable width of the first support means—is at least about 2600 mm. The external width, that is to say the spacing of the outsides of the longitudinal beams of the carrying frame, can be for example about 3000 mm.

By virtue of selecting the length of the arms in such a way that the first support means for the cargo, in a first pivotal position of the arms, is prolonged by the at least one second support means in such a way that it can be driven on and the at least one second support means in a second pivotal position of the arms is raised relative to the first support means of the carrying frame this can afford different possible options in terms of loading the carrying apparatus. In particular there can be different possible options for loading the first support means and/or the second support means. Thus for example cargo can be loaded on the first support means (supported thereon) without the second support means being loaded with cargo. It is also possible for cargo to be loaded (supported) on the first and the second support means. In the first pivotal position of the arms it is possible to drive on the first support means over the second support means. The second support means can adjoin the first support means substantially horizontally (flat) in the first pivotal position of the arms.

Because the second support means is pivotable between a first pivotal position and a second pivotal position it is possible to adapt the driveway formed by the first support means and the second support means to a predetermined contour, for example a support surface or a pocket of a railway pocket wagon.

It is provided that the carrying apparatus has contact support surfaces for direct placement of the carrying apparatus on a terminal floor. Accordingly for placement and possibly travel movement of the carrying apparatus there is no need for a stationary carrier structure which would have to be provided as a special arrangement in every terminal.

It is particularly preferably provided that when the carrying apparatus is lowered on to a rail vehicle, in particular upon being lowered into a pocket of a pocket wagon, the arms are pivotable by the lowering movement into the second pivotal position. A part of the first support device (for example the second support means) in the lowering movement comes into contact on the rail vehicle (for example contact on a container stud of the rail vehicle). That contact is maintained when the lowering movement is continued, which leads to the above-described pivotal movement of the arms relative to the carrying frame of the support device.

It can be advantageous if the arms are arranged outside outsides or within the longitudinal beams.

Arranging the arms outside insides of the longitudinal beams can provide a structurally simple solution in regard to the configuration and arrangement of the arms, in which the continuous internal width (W) between the longitudinal beams of the carrying frame, that is made possible by the width of the first support means, is not reduced by the arms. In that case the arms can be arranged substantially completely outside outsides of the longitudinal beams.

Even when the arms are arranged within the longitudinal beams it can be provided that the continuous internal width between the longitudinal beams of the carrying frame, that is made possible by the width of the first support means, is not reduced by the arms. That can be achieved for example by the longitudinal beams of the carrying frame, in an upper end region (in the region of an end of the longitudinal beams, that faces away from the first support means), having a crank offset outwardly (directed away from the first support means). In another configuration the arms can be arranged at least partially within and/or above the longitudinal beams of the carrying frame.

It can be advantageous if the pivot bearings of the arms are arranged on the longitudinal beams at an end region, remote from the first support means, of the longitudinal beams—preferably at an end region of the longitudinal beams, that is an upper end region in the vertical direction. Such an arrangement of the pivot bearings of the arms means that the horizontal spacing of the second support means from the first support means can be increased upon pivotal movement of the first support device. If the carrying apparatus upon use thereof jointly with a railway pocket wagon is arranged (at least partially) within the pocket of the pocket wagon it can be provided that the pivot bearings and optionally the arms are disposed outside the pocket, by virtue of the arrangement of the pivot bearings of the arms at an upper end region of the longitudinal beams. In that way it is possible to make optimum use of the available space within the pocket.

It can be advantageous if the second support means of the at least one first support device is in the form of a carrying surface or in the form of a plurality of struts. When the second support means is in the form of a plurality of struts it can be provided that the supported load, for example a tire of a vehicle, projects partially between the struts.

It can be advantageous if the carrying apparatus has a device for arresting the pivotability of the arms. Such an arresting action can be effected by way of releasable fixing of the arms to the longitudinal beams (for example by way of pins or bolts). Fixing of the arms can be effected in a first pivotal position of the first support device. When the first support device is arrested in the first pivotal position the prolongation, which can be driven on, of the first support means by the second support means can be fixed independently of a contact support surface of the carrying apparatus. In that way the carrying apparatus, for example when used with a railway pocket wagon, can be used as a flat load surface, similarly to a railway flat wagon. It will be appreciated that the carrying apparatus can also be used in relation to a railway flat wagon.

It can be advantageous if the carrying apparatus has at least one first support device and a second support device with at least a third support means for the cargo. The first support device and the second support device can be loadable with cargo independently of each other. In that case it can be provided that the second support means of the first support device can be arranged at a first end of the first support means and the third support means of the second support device can be arranged at a second end (opposite the first end) of the first support means.

In that case it can be advantageous if the second support device is mounted pivotably relative to the carrying frame. In that case the second support device can be mounted pivotably relative to the first support means of the carrying frame. The pivot bearings of the mounting of the second support device can be arranged at the second end of the first support means.

In that respect it can be advantageous if the first support means in a first pivotal position of the second support device is prolonged substantially horizontally by the at least one third support means in such a way that it can be driven on. The third support means can therefore adjoin the first support means in substantially flat relationship. In that respect it can be provided that the third support means in the first pivotal position terminates substantially flush with the longitudinal beams of the carrying frame—possibly except for ramp-like extensions—. When using the carrying apparatus with a railway pocket wagon it can be possible for example in that way that the third support means of the second support device can be arranged jointly with the first support means of the carrying frame substantially completely within the pocket of the pocket wagon.

In that respect it can further be advantageous if the at least one third support means in a second pivotal position of the second support device can be arranged at an angle of inclination relative to the first support means of the carrying frame. In that way it is possible for the driveway formed by the first support means and the third support means to be adapted to a predetermined contour, for example a contact support surface or a pocket of a railway pocket wagon.

For the second support device it can be advantageous if the third support means of the second support device is in the form of a carrying surface and/or in the form of a plurality of struts. When the third support means is in the form of a plurality of struts it can be provided that the supported cargo load, for example a tire of vehicle, projects partially between the struts.

For the second support device it can be advantageous if the third support means is adapted to be variable in length. In that way the length of the third support means can be adapted to the cargo. The third support means can be variable in length between a state of reduced length and at least one state of increased length. It can be provided in that case that the third support means in the first pivotal position in the reduced-length state terminates substantially flush with the longitudinal beams of the carrying frame—possibly except for ramp-like extensions—.

In that respect it can be advantageous if the third support means is variable in length by at least one extension portion. Laterally projecting extensions can be arranged at the at least one extension portion. In the retracted position the at least one extension portion can be stowed substantially completely—possibly except for projecting extensions—in a base part of the third support means. In a preferred configuration the third support means has two interlaced telescopically extendable extension portions. It can be provided that the extension portion (or portions) can be arranged in at least one extension position.

Figure 3A:
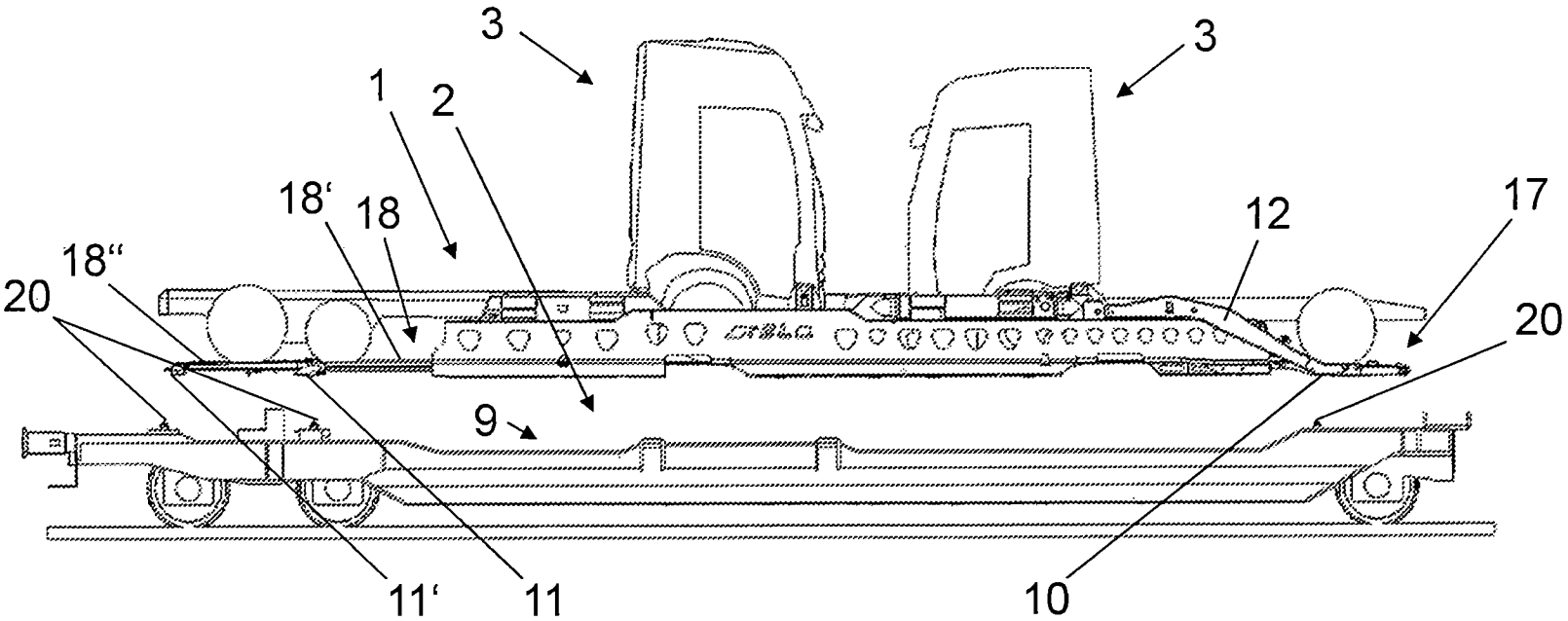
Figure 3B:
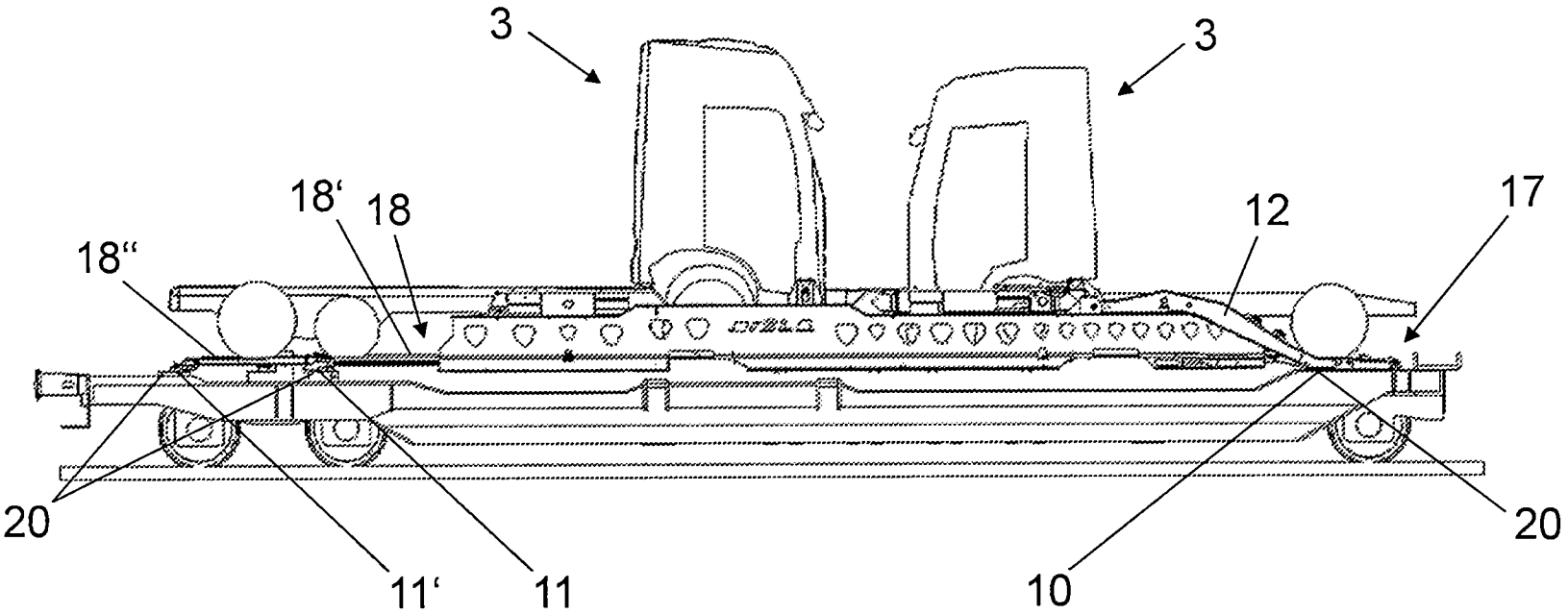
Figure 3C:
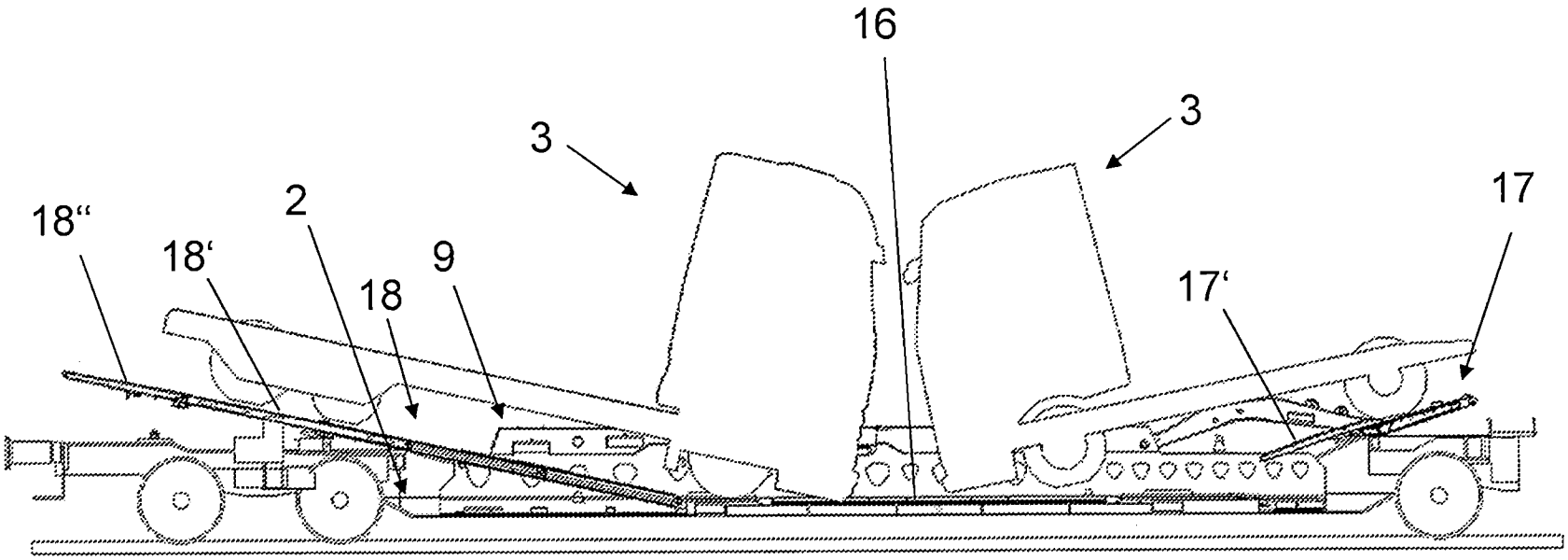
Figure 3D:
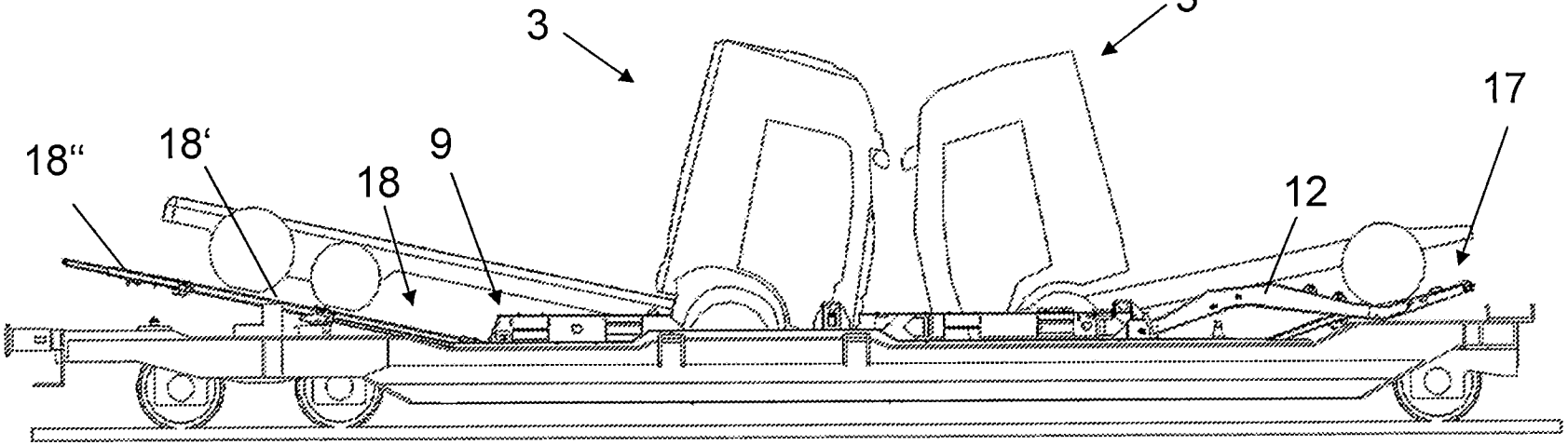
Figure 4A:
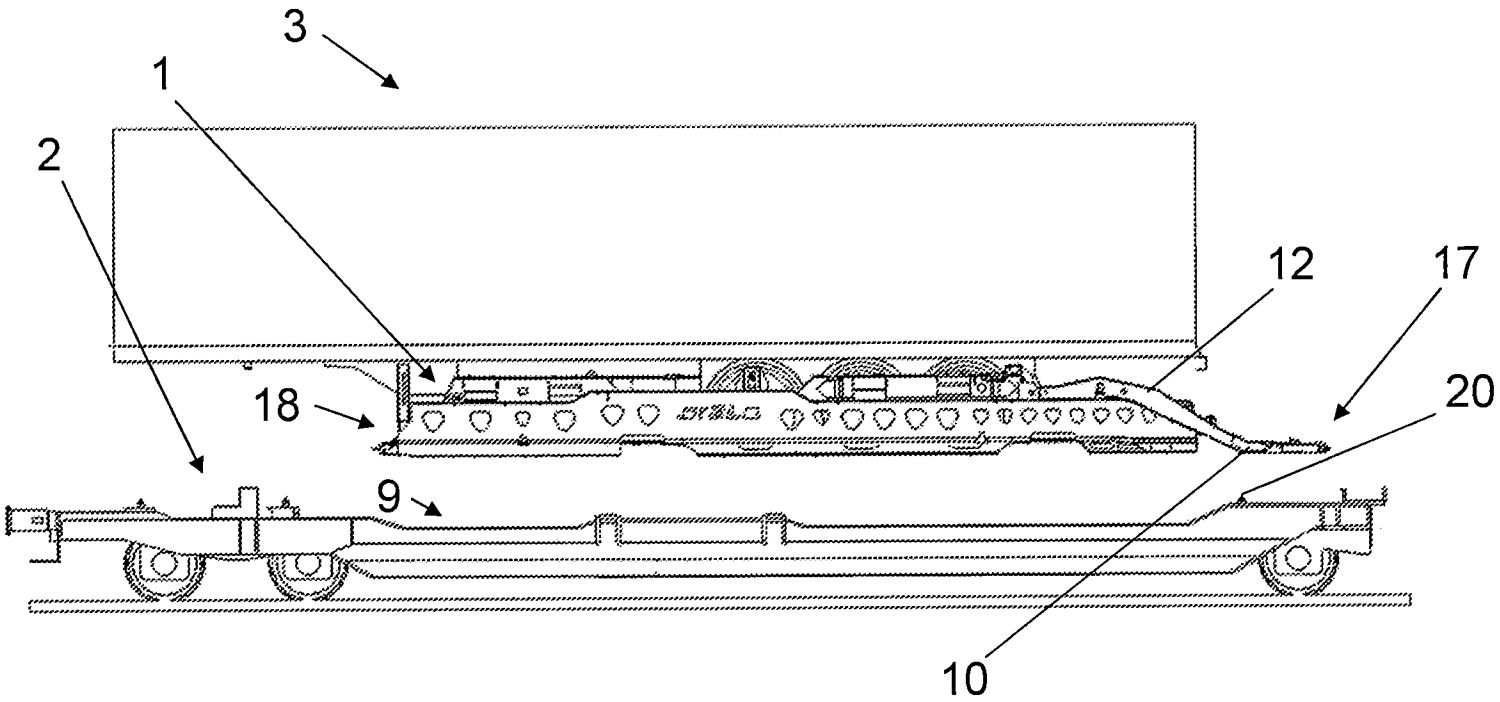
Figure 4B:
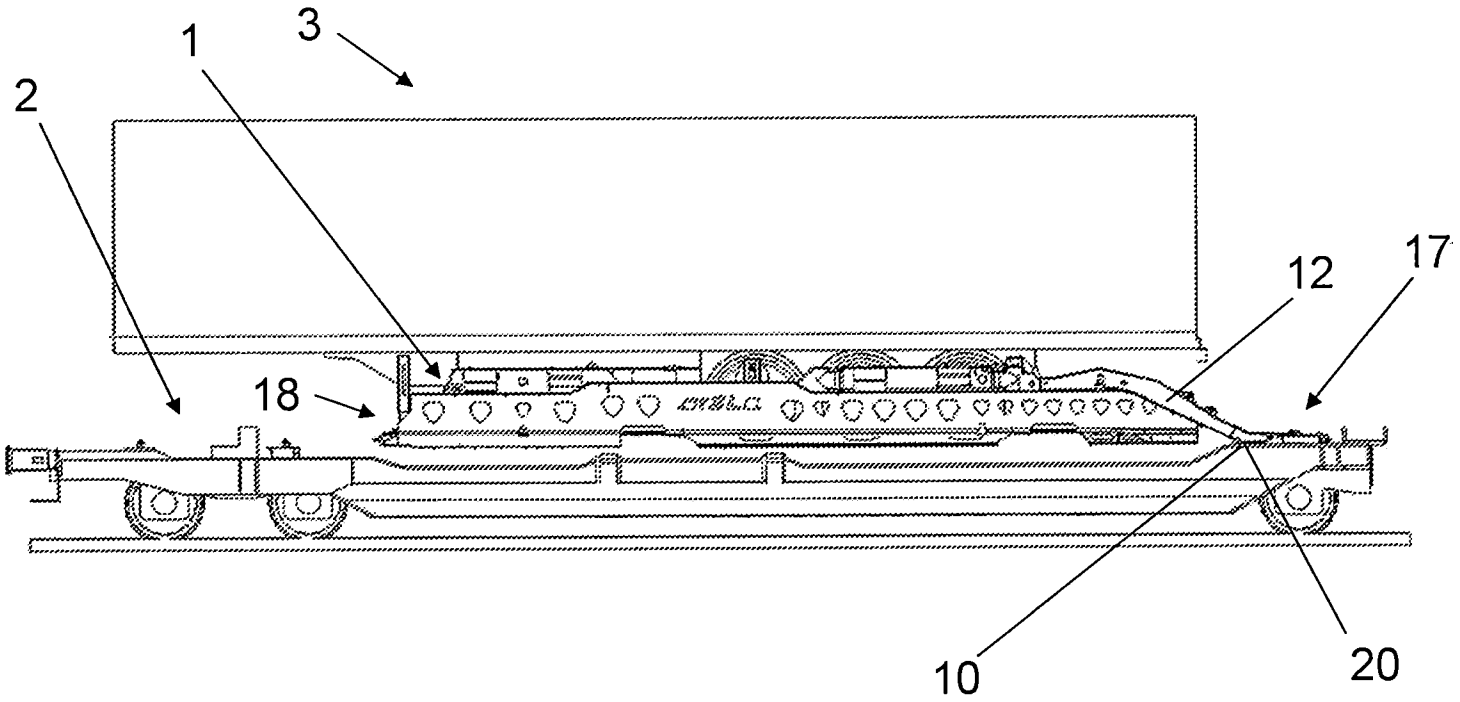
Figure 4C:
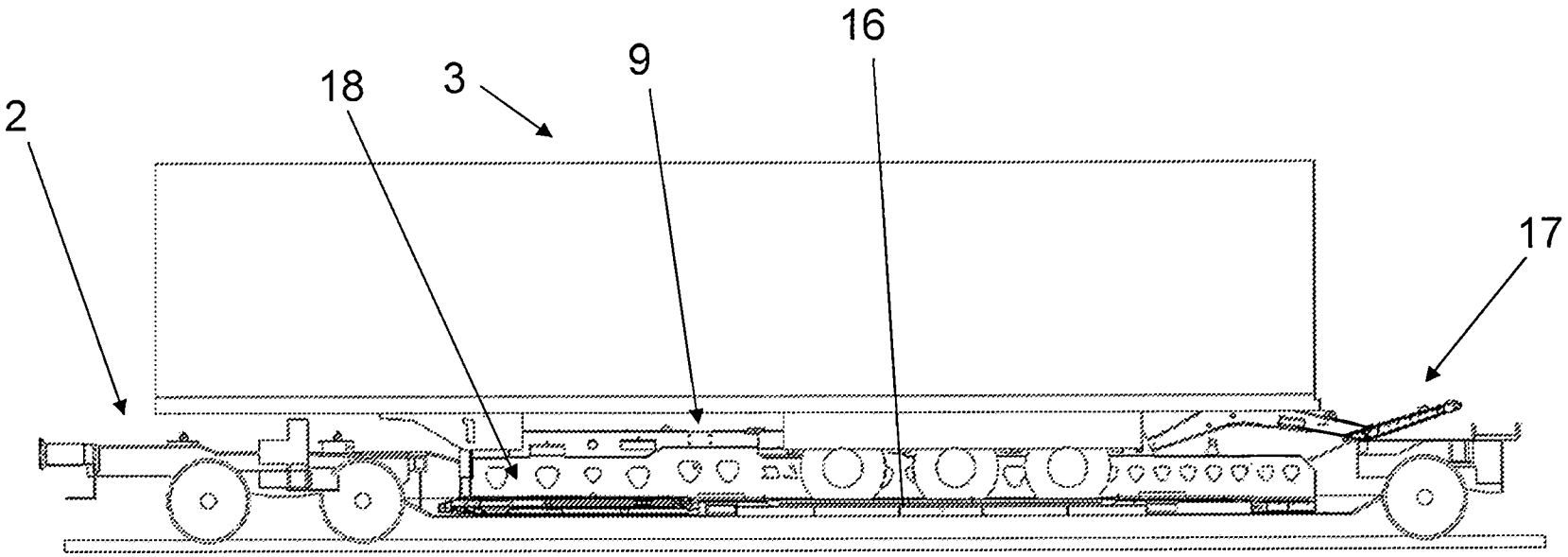
Figure 4D:
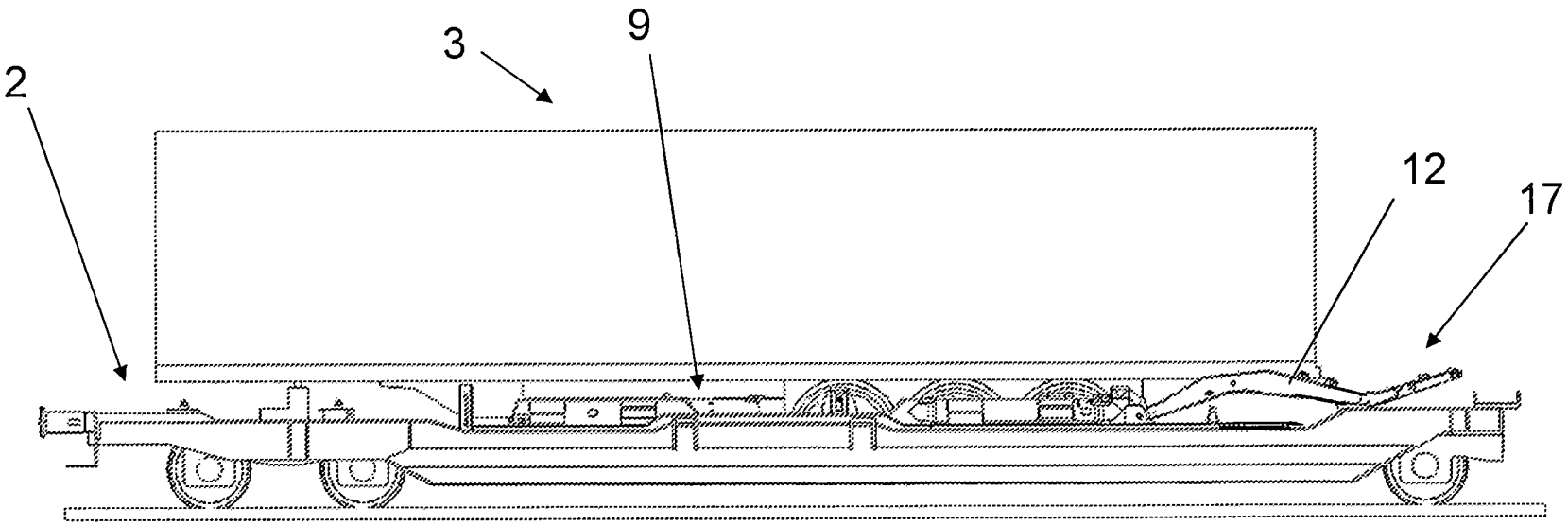
Figure 5A:
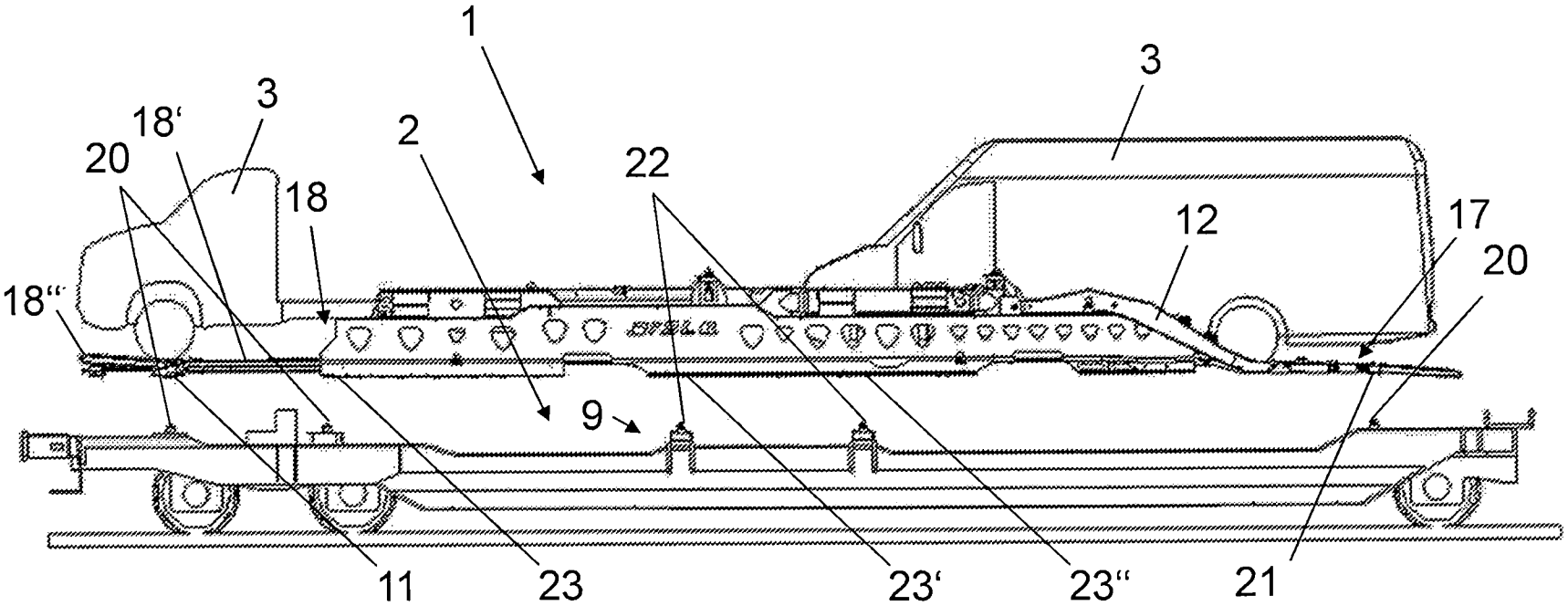
Figure 5B:
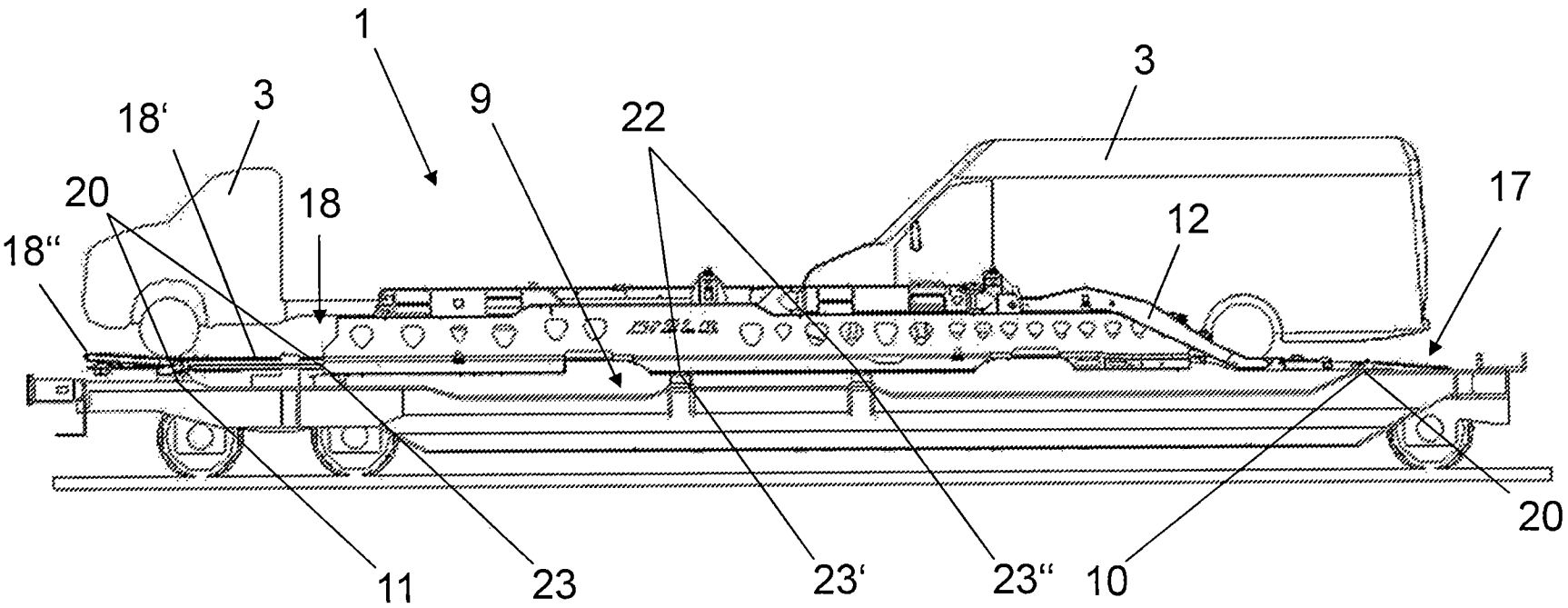

Embodiments of the invention are discussed with reference to the Figures in which:

FIGS. 1*a-e* show an isometric view, a plan view, a first and a second side view and a front view of a carrying apparatus according to the invention in a first configuration, FIGS. 2*a-e* show an isometric view, a plan view, a first and a second side view and a rear view of the carrying apparatus according to the invention as shown in FIG. 1 in a second configuration, FIGS. 3*a-c*, 3*d* show a sequence of a loading operation of a rail vehicle in the form of a pocket wagon with load in the form of two traction units and a side view after termination of the loading operation, FIGS. 4*a-c*, 4*d* show a sequence of a loading operation of a rail vehicle in the form of a pocket wagon with load in the form of a semitrailer, and a side view after termination of the loading operation, and FIGS. 5*a-b* show a sequence of a loading operation of a rail vehicle in the form of a pocket wagon with load in the form of transporters.

FIG. 1*a* shows an isometric view of an embodiment of a carrying apparatus 1 according to the invention for loading a rail vehicle 2 with cargo load 3 by a lifting apparatus (not shown) by means of the receiving pockets 5 in a first configuration. The illustrated configuration corresponds to the receiving position.

The carrying apparatus 1 has a carrying frame 8, with two longitudinal beams 4 which extend relative to each other with mutually facing insides and which are connected with each other.

The carrying frame 8, over a part of the length of the two longitudinal beams 4, at an end of the longitudinal beams that is the lower end in the vertical direction, has a first support means 16 for the load 3, which can be driven on up to a maximum width transversely to the two longitudinal beams 4.

There is further provided a first support device for load 3, which has arms 12 mounted pivotably to the carrying frame 8 and between which a second support means 17 for cargo 3 is arranged.

The arms 12 are arranged outside the width, which can be driven on, of the first support means 16 for the cargo 3 on pivot bearings 13. In the present embodiment the pivot bearings 13 are disposed partially within a profiled portion of the longitudinal beams 4 and partially at the outsides of the longitudinal beams 4.

A length of the arms 12 is so selected that the first support means 16 for cargo in the first pivotal position of the arms 12, illustrated in FIGS. 1*a-e*, is prolonged by the second support means 17 in such a way that it can be driven on. The second support means 17 adjoins a first end of the first support means 16 in substantially flat relationship. A second support device with the third support means 18 adjoins a second end of the first support means 16. The support means 18 is shown in a first pivotal position in which it adjoins the first support means 16 in substantially flat relationship.

As illustrated the second support means 17 can be prolonged by a prolongation 17' in the direction of the first support means 16. That permits a prolongation of the support surface of the second support means 17, in particular in a second pivotal position of the first support device, as illustrated in FIG. 2. That is helpful for transporting vehicles with more than two axles.

It is advantageous for the second support device if the third support means 18 is adapted to be variable in length as illustrated. In that way the length of the third support means 18 can be adapted to cargo 3. In that case the third support means 18 is variable in length between a state of reduced length (see FIG. 1*d*) and a state of increased length (see FIGS. 1*a-c*). In the illustrated embodiment the variability in length is achieved by two interlaced telescopically extendable extension portions 18', 18".

In the illustrated embodiment the second and third support means 17, 18 are in the form of a carrying surface. Unlike the illustrated structure they can also be in the form of a plurality of struts.

Figure 1B:
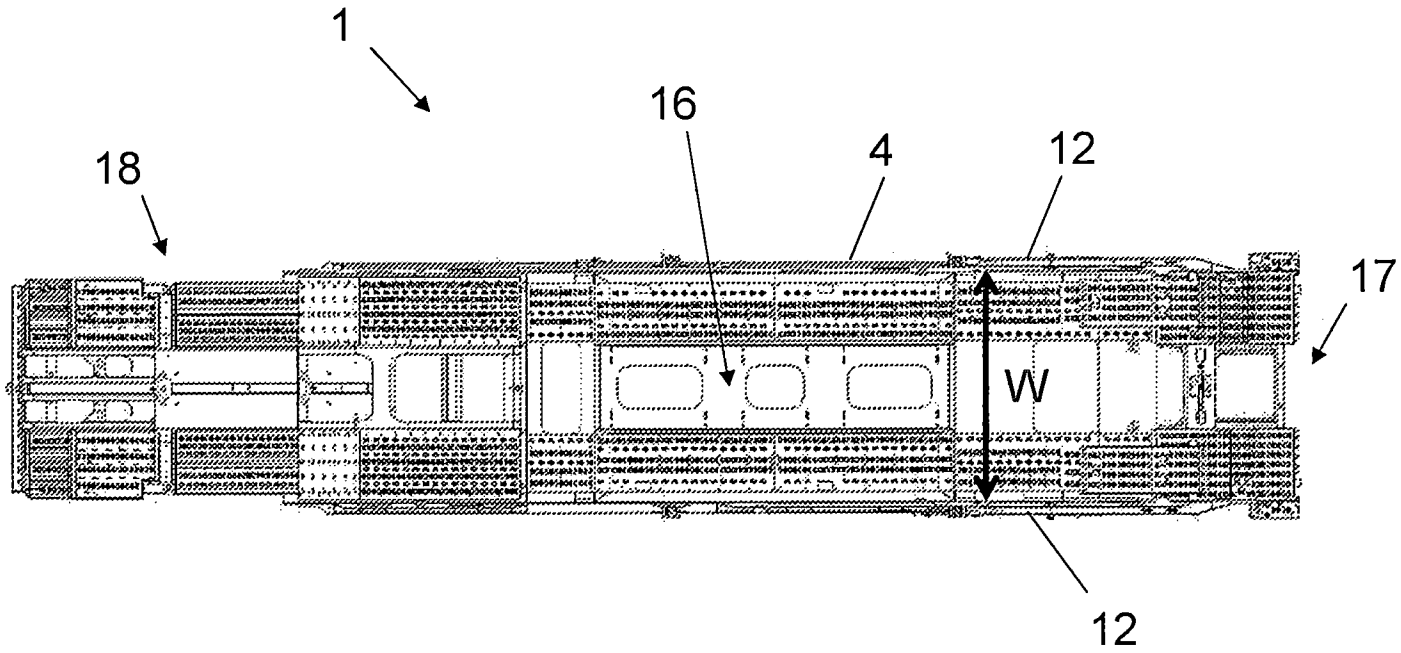

It can be seen from the plan view in FIG. 1*b* that the carrying apparatus 1 has a continuous internal width W which is not restricted by the arms 12 (see FIG. 1*e*) so that this affords a driveway which can be continuously driven on throughout.

Figure 1C:
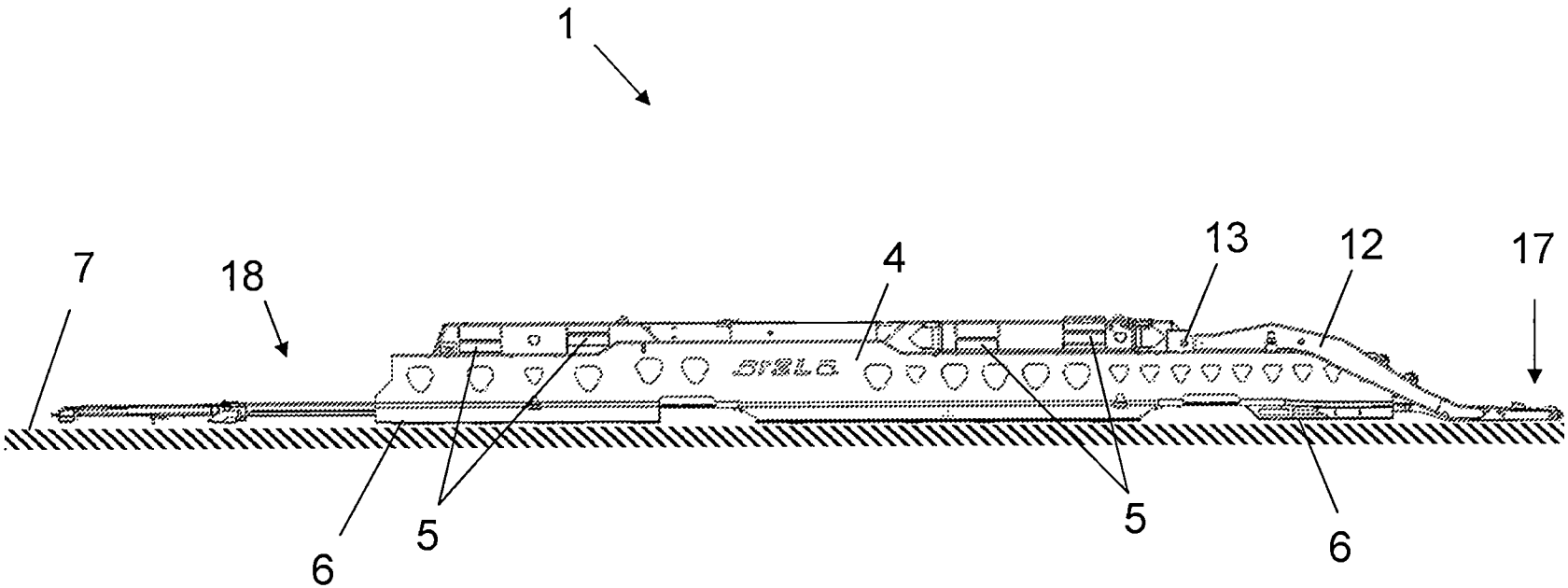

The first side view in FIG. 1*c* shows the first and second support devices respectively in the first pivotal position thereof. In that state for example the carrying apparatus 1 is disposed standing directly on a terminal floor 7 by way of contact support surfaces 6 and can be driven on from both sides.

The pivot bearings 13 of the arms 12 in this embodiment are disposed in an end region of the longitudinal beams 4, that is the upper end region in the vertical direction.

Figure 1D:
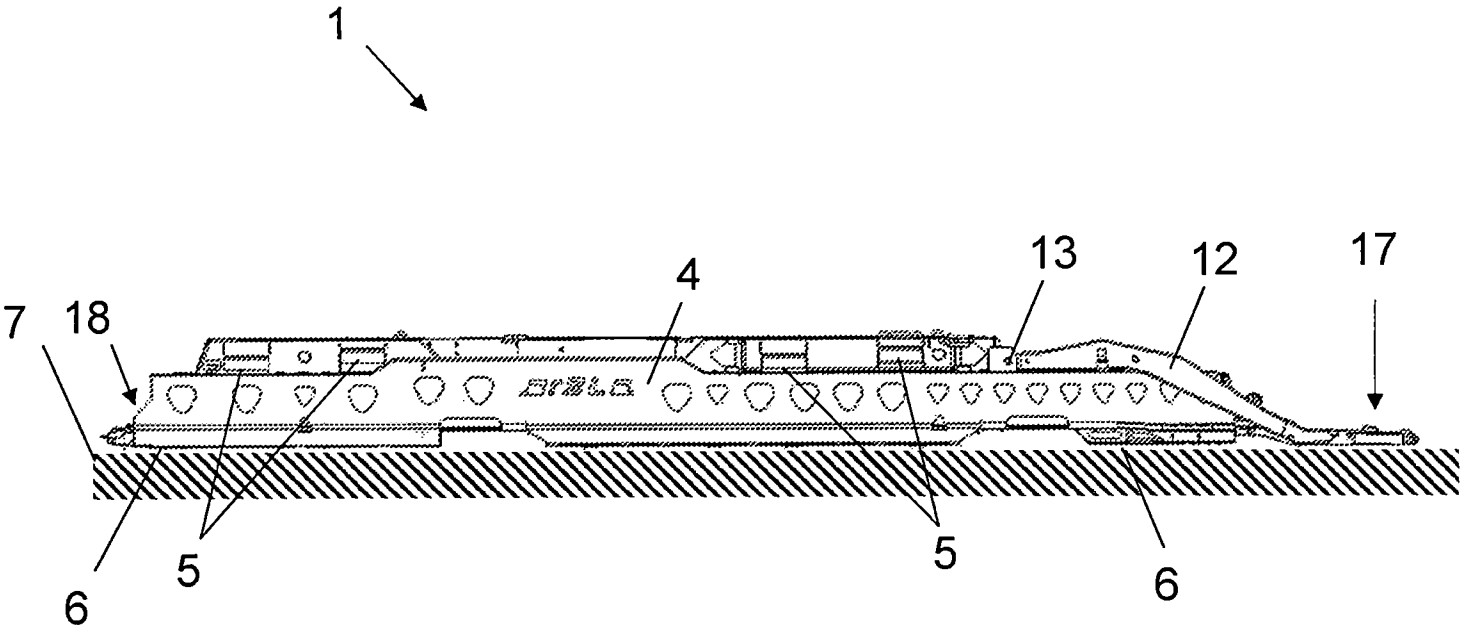

In the second side view in FIG. 1*d* the second support device is disposed in a reduced-length state which is afforded by the extension portions 18', 18" being substantially completely retracted. The third support means 18 of the second support device terminate substantially flush with the end of the longitudinal beams 4, except for ramp-like extensions.

Figure 1E:
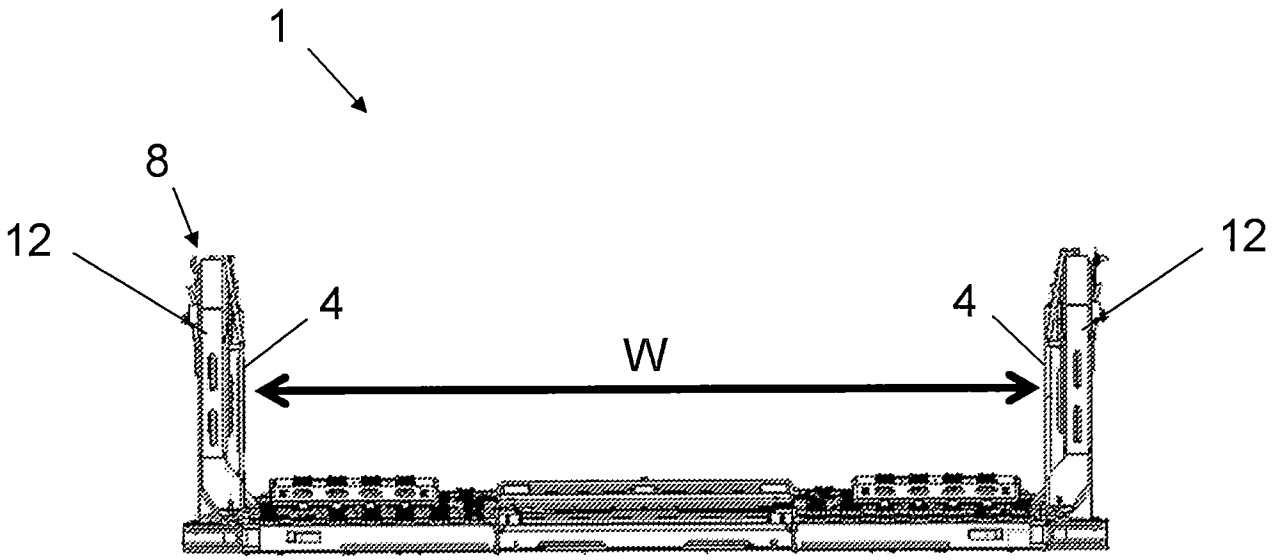

Again from the front view of FIG. 1*e* that the carrying apparatus 1 has a continuous internal width W which is not restricted by the arms 12 so that this gives a driveway which can be continuously driven on. In the present embodiment the arms 12 are disposed partially within a profiled portion of the longitudinal beams 4 and partially completely at the outsides of the longitudinal beams 4.

Figure 2A:
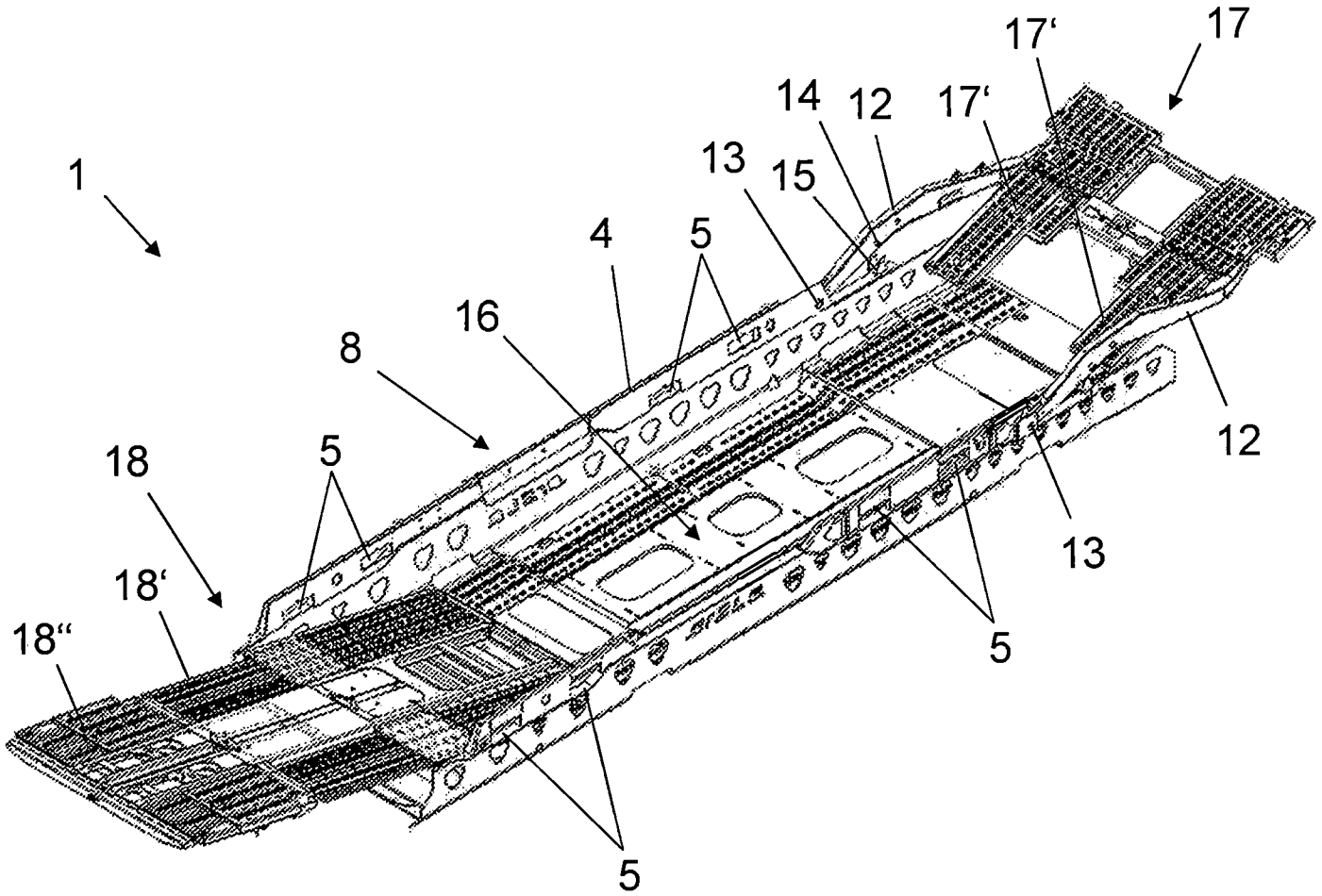
Figure 2B:
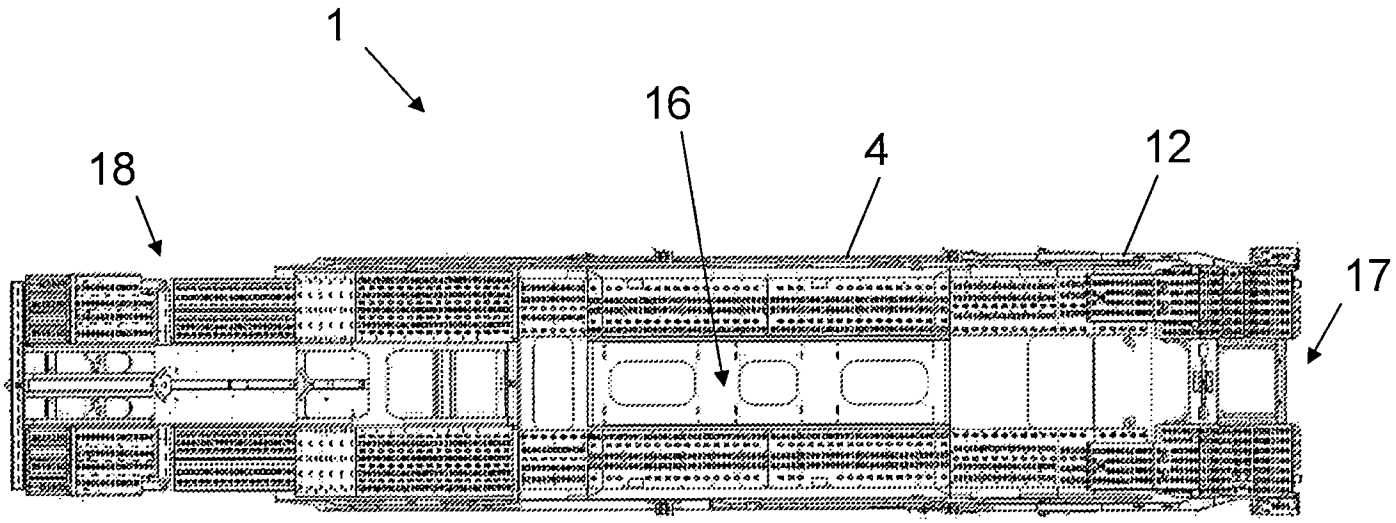

FIG. 2*a* shows an isometric view of the embodiment of the carrying apparatus 1 shown in FIG. 1 in a second configuration in which the first and second support devices are respectively disposed in the second pivotal position. That configuration corresponds to that state of the carrying apparatus 1, which can be afforded of its own accord by insertion of the carrying apparatus 1 into a pocket 9 of a rail vehicle 2 in the form of a pocket wagon, using a lifting apparatus. The illustrated configuration corresponds to a loading position.

The second support means 17 is raised relative to the first support means 16 of the carrying frame 8.

The third support means 18 of the second support device is arranged inclinedly relative to the first support means 16 and, by virtue of the prolongation by the extension portions 18', 18", projects beyond the end of the longitudinal beams 4.

It can be seen that the arms 12 in this configuration are in a raised position in comparison with the configuration shown in FIG. 1. In this configuration it is possible to see openings 14 for pins (not shown) and receiving means 15 for the arms 12 which serve for releasably arresting the arms 12 to the longitudinal beams 4.

Figure 2C:
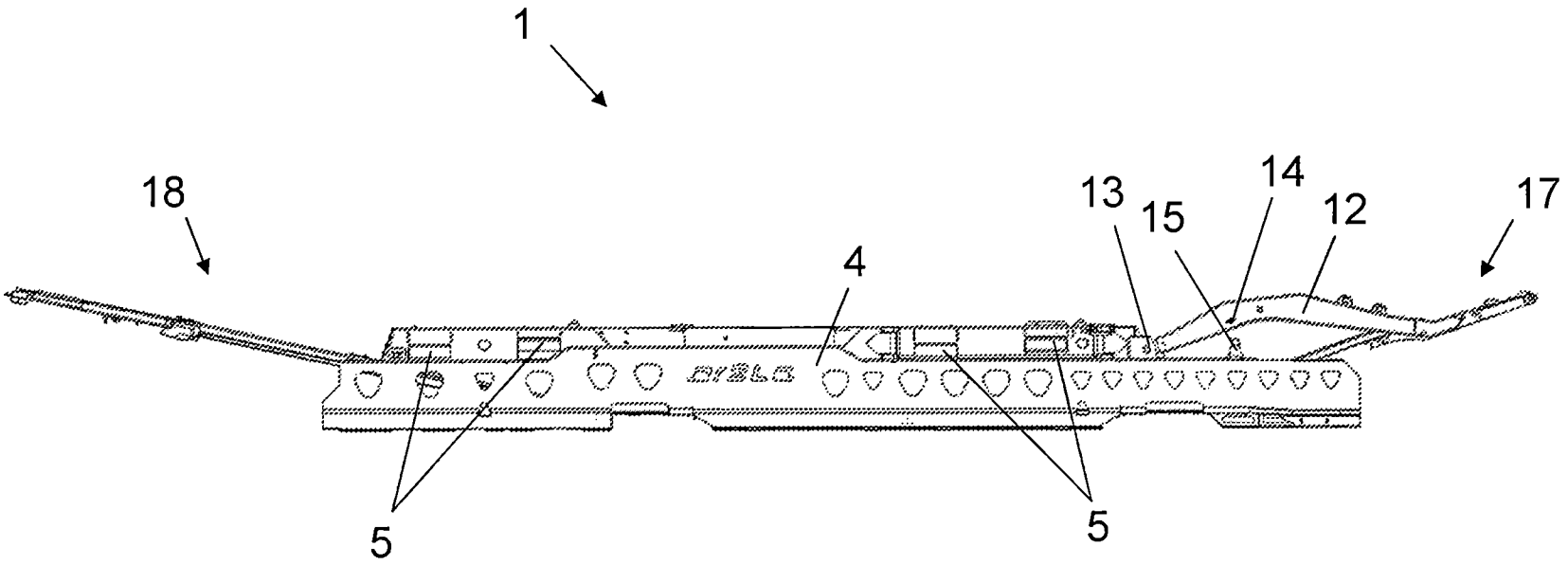

The first side view of FIG. 2*c* shows the respective first and second support devices in the second pivotal position thereof. As here the second support device is in an increased-length state which is afforded by substantially complete extension of the extension portions 18', 18", insertion into a pocket 9 of a rail vehicle 2 in the form of a pocket wagon results in pivotal movement of the third support means 18 from the first pivotal position into the second pivotal position of the second support device.

Figure 2D:
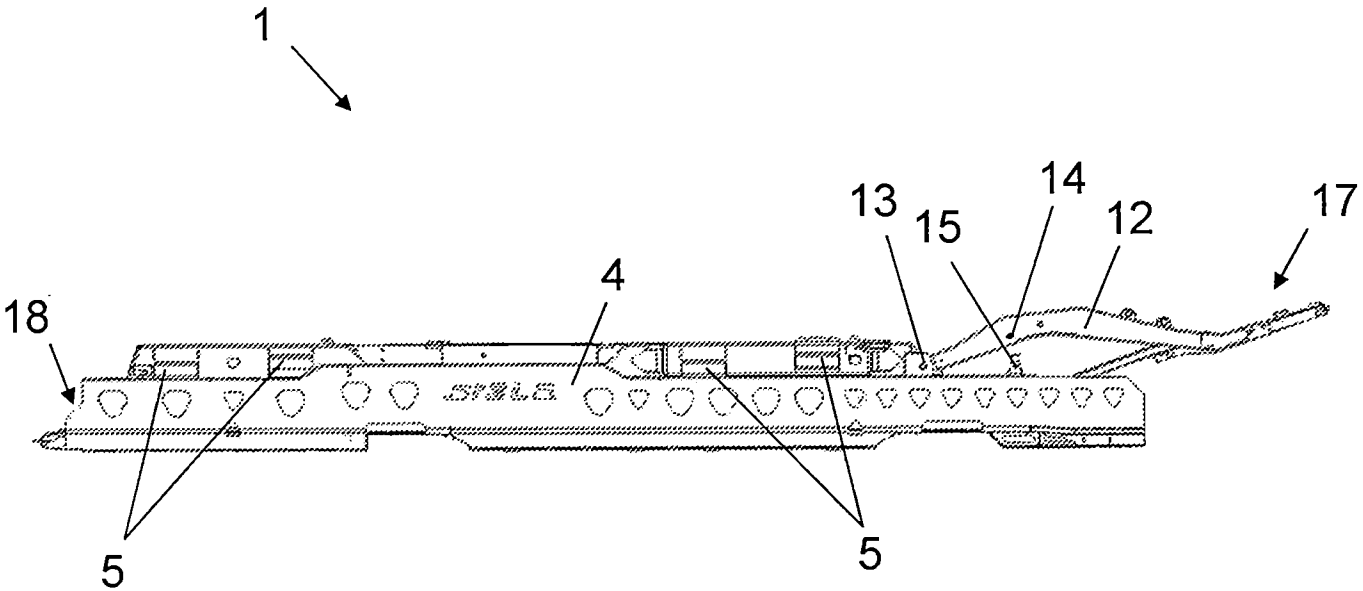
Figure 2E:
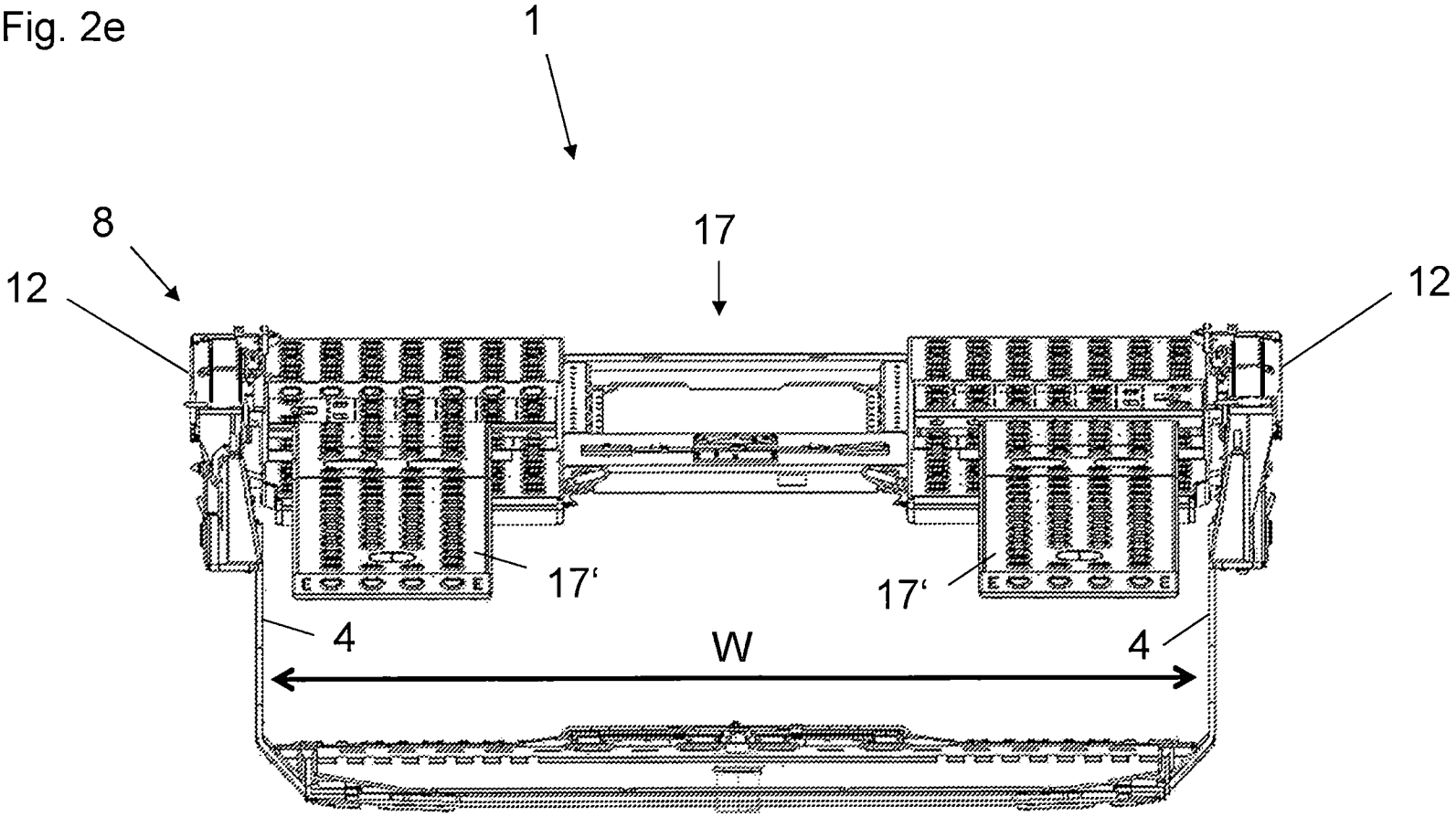

In the second side view in FIG. 2*d* the second support device is in a reduced-length state which is afforded by substantially complete retraction of the extension portions 18', 18". As here insertion into a pocket 9 of a rail vehicle 2 in the form of a pocket wagon does not involve pivotal movement of the third support means 18 of the second support device it remains in the first pivotal position.

FIGS. 3*a-c* show a sequence of a loading operation of a rail vehicle 2 in the form of a pocket wagon with cargo in the form of two traction units. The cargo in the form of the two traction units is in that case placed with wheels on the first support means 16, the second support means 17 and the third support means 18 prolonged by the extension portions 18', 18".

FIG. 3*a* shows a state in which the carrying apparatus 1 is just lowered by way of a lifting apparatus (not shown) in the direction of the pocket wagon (or has been lifted out of same), in which case there is no contact (or no longer contact) between the carrying apparatus 1 and the pocket wagon. The second support device is in the increased-length state. The arms 12 of the first support device are disposed in their first pivotal position. The pocket wagon has projecting studs 20 with which the first contact surface 10 of the first support device and the contact surfaces 11, 11" of the second support device come into contact after further lowering movement of the carrying apparatus 1, as shown in FIG. 3*b*.

FIG. 3*c* shows the carrying apparatus 1 fitted into the pocket 9 of the pocket wagon as a sectional view (section plane within the pocket wagon along a longitudinal extent thereof). By virtue of the contact of the studs 20 with the contact surfaces 10, 11 of the first and second support devices and the lowering movement performed the second support means 17 of the first support device and the third support means 18 of the second support device have been pivoted into their second pivotal position. As illustrated the second support means 17 (apart from its prolongation 17' directed into the interior of the carrying apparatus 1) is disposed completely outside and above the pocket 9, whereby the illustrated cargo 3 can use the space outside the pocket 9 for support. The third support means 18 of the second support device is disposed partially outside and partially within the pocket 9 in an orientation extending inclinedly relative to the horizontal. The first support means 16 is disposed completely within the pocket 9. The illustrated configuration corresponds to a loading position.

FIG. 3*d* shows the state illustrated in FIG. 3*c*, but not in a sectional view, but as a side view. It can be seen that, of the carrying apparatus 1, only the second support means 17 (apart from its prolongation 17' directed into the interior of the carrying apparatus 1) and a part of the third support means 18 projects beyond a load edge defined by the height of a side wall of the pocket wagon. In the second pivotal position of the arms 12 with the carrying apparatus 1 lowered into the pocket 9 they are disposed substantially completely above the load edge of the pocket 9.

FIGS. 4*a-c* show a sequence of a loading operation of a rail vehicle 2 in the form of a pocket wagon with cargo 3 in the form of a semitrailer similarly to the view in FIG. 3*a*, with the difference that the third support means 18 of the second support device is in the reduced-length state. No contact of the contact surface 11 of the second support device with a stud 20 of the pocket wagon occurs. As a result the second support device remains in the first pivotal position (see FIGS. 4*c* and 4*d*) when the carrying apparatus 1 is lowered into the pocket 9. With this kind of cargo 3 the prolongation 17' of the second support means 17 does not have to be used. The illustrated configuration corresponds to a loading position.

FIG. 4*c* shows that, by virtue of the use of the arms 12, it is possible to select a spacing between the second support means 17 and the pivot bearings 13 which define the pivot axis of the pivotal movement of the second support means 17, in such a way that substantially the load space between the longitudinal beams 4 can be used over the overall internal width W and length for cargo 3 and more specifically both in the first and also in the second pivotal position of the first support device.

FIG. 4*d* shows the state illustrated in FIG. 4*c*, although not as a sectional view but a side view. It can be seen that, of the carrying apparatus 1, only the second support means 17 projects beyond a load edge defined by the height of a side wall of the pocket wagon. By virtue of the fact that there is no pivotal movement of the second support device the third support means 18 is arranged jointly with the first support means 16 completely in the pocket 9. In the second pivotal position of the arms 12 with the carrying apparatus 1 lowered into the pocket 9 they are disposed substantially completely above the load edge of the pocket 9.

FIGS. 5*a* and 5*b* show a sequence of a loading operation of a rail vehicle 2 in the form of a pocket wagon with a carrying apparatus 1, on which cargo 3 in the form of transporters is placed. Loading is effected in the manner of a flat wagon with a substantially flat load surface.

The carrying apparatus 1 can be lifted on to the rail vehicle 2 by a lifting apparatus (not shown) selectively as illustrated in a state of being loaded with cargo 3 or in an unloaded state. In that use situation the arms 12 are releasably fixed by way of bolts and openings 14 to receiving means 15 of the longitudinal beams 4 (see in that respect FIG. 2*c*).

Prior to the loading operation the carrying apparatus 1 can be placed directly on a terminal floor 7 and loaded with drivable cargo 3 in the form of transporters (by driving on the transporters).

In contrast to FIGS. 3*a* and 4*a* the carrying apparatus 1 is displaced by a displacement in the longitudinal direction with respect to the pocket 9 of the pocket wagon in such a way that upon continued lowering movement contact between the stud 20 of the pocket wagon and the contact surface 23 of the carrying frame occurs, being disposed at the end of the carrying frame 8 towards the second support means 17 (see FIG. 5*b*).

The fixed first support device has come into contact with a second contact surface 21 with the stud 20 of the pocket wagon. The second contact surface 21 is arranged in accordance with the displacement of the carrying apparatus 1 in the longitudinal direction relative to the pocket wagon at the first support device, wherein that can possibly be effected using a further prolongation.

In the state shown in FIG. 5*b* in which the lifting operation is concluded and the carrying apparatus 1 is supported on the pocket wagon the carrying frame 8 is additionally supported with contact surfaces 23', 23" at intermediate support means 22 of the pocket wagon above the pocket 9.

A pocket wagon loaded with the carrying apparatus 1 according to the invention, in the case of the flat wagon use shown in FIG. 5, can be continuously driven on over its entire length, in the sense that for example a plurality of transporters can be successively driven on to the pocket wagon. If a plurality of pocket wagons are combined together to form a train then transporters can drive from one pocket wagon to another if each of the pocket wagons to be driven on is loaded with a carrying apparatus 1 according to the invention.

Naturally cargo 3 which is not self-drivable (like for example containers) can also be lifted on to the carrying apparatus 1.

LIST OF REFERENCES

1 carrying apparatus
2 rail vehicle
3 cargo
4 longitudinal beam
5 receiving pocket
6 contact support surface of the carrying apparatus
7 terminal floor
8 carrying frame
9 pocket of a pocket wagon
10 first contact surface of the first support device
11, 11' contact surfaces of the second support device
12 arm
13 pivot bearing of the arms
14 openings for bolts
15 receiving means for arm
16 first support means
17 second support means
17' prolongation of the second support means
18 third support means
18' first extension portion of the third support means
18" second extension portion of the third support means
19 tractor vehicle
20 stud of a pocket wagon
21 second contact surface of the first support device
22 intermediate support of a pocket wagon
23, 23', 23" contact surfaces of the carrying frame
W continuous internal width

The invention claimed is:

1. A liftable carrying apparatus for loading a rail vehicle with cargo by a lifting apparatus, comprising:

a carrying frame having at least two longitudinal beams which extend relative to each other with mutually facing insides and which are connected with each other, wherein the carrying frame has a first support means for the cargo at over at least a part of a length of the at least two longitudinal beams, the first support means configured to be driven on up to a maximum width transversely relative to the at least two longitudinal beams, a receiving location for receiving the lifting apparatus, contact surfaces for direct placement of the carrying apparatus on a terminal floor, and a second support means for cargo, the second support means being arranged at or between arms of a first support device, wherein the arms are arranged outside a drivable width of the first support means for cargo on pivot bearings, wherein a length of the arms is such that the first support means for the cargo in a first pivotal position of the arms is prolonged by the second support means so that the first support means can be driven on and so that the second support means is raised in a second pivotal position of the arms relative to the first support means of the carrying frame, and wherein the arms of the first support device are configured such that, when the carrying apparatus is lowered on to a rail vehicle, the arms are pivotable by the lowering movement into the second pivotal position.

2. The carrying apparatus as set forth in claim 1, wherein the second support means of the first support device is a carrying surface or a plurality of struts.

3. The carrying apparatus as set forth in claim 1, further comprising a device for releasable arresting of the pivotability of the arms.

4. The carrying apparatus as set forth in claim 3, wherein the releasable arresting of the arms is effected with the longitudinal beams.

5. The carrying apparatus as set forth in claim 1, wherein the carrying apparatus has the first support device, a second support device, and a third support means for supporting the cargo, wherein the first support device and the second support device are configured to be loaded with cargo independently of each other.

6. The carrying apparatus as set forth in claim 5, wherein the second support device is mounted pivotably relative to the carrying frame.

7. The carrying apparatus as set forth in claim 6, wherein the first support means in a first pivotal position of the second support device is prolonged substantially horizontally by the third support means such that the first support means can be driven on and the third support means in a second pivotal position of the second support device can be arranged at an angle of inclination relative to the first support means of the carrying frame.

8. The carrying apparatus as set forth in claim 6, wherein the second support device is mounted pivotably relative to the first support means of the carrying frame.

9. The carrying apparatus as set forth in claim 5, wherein the third support means is configured to be variable in length.

10. The carrying apparatus as set forth in claim 5, wherein the third support means of the second support device is a carrying surface and/or a plurality of struts.

11. The carrying apparatus as set forth in claim 1, wherein the arms have a bent or cranked configuration at least portion-wise.

12. The carrying apparatus as set forth in claim 11, wherein the third support means is variable in length by at least one extension portion which can preferably be arrested in at least one extension position.

13. A rail vehicle comprising the carrying apparatus as set forth in claim 1.

14. A pocket wagon comprising a pocket and the carrying apparatus as set forth in claim 1, wherein the carrying apparatus is at least partially arranged within the pocket.

15. The carrying apparatus as set forth in claim 1, wherein the first support means for supporting the cargo is located at the lower end in the vertical direction, and has a first support means for the cargo.

16. The carrying apparatus as set forth in claim 1, wherein the receiving location is receiving pockets.

17. The carrying apparatus as set forth in claim 1, wherein when the carrying apparatus is lowered into a pocket of a pocket wagon when lowered on to a rail vehicle.

18. A liftable carrying apparatus for loading a rail vehicle with cargo by a lifting apparatus, comprising:

a carrying frame having at least two longitudinal beams which extend relative to each other with mutually facing insides and which are connected with each other, wherein the carrying frame has a first support means for the cargo at over at least a part of a length of the at least two longitudinal beams, the first support means configured to be driven on up to a maximum width transversely relative to the at least two longitudinal beams, a receiving location for receiving the lifting apparatus, contact surfaces for direct placement of the carrying apparatus on a terminal floor, and a second support means for cargo, the second support means being arranged at or between arms of a first support device, wherein the arms are arranged outside a drivable width of the first support means for cargo on pivot bearings, wherein a length of the arms is such that the first support means for the cargo in a first pivotal position of the arms is prolonged by the second support means so that the first support means can be driven on and so that the second support means is raised in a second pivotal position of the arms relative to the first support means of the carrying frame, and wherein the arms are arranged outside outside surfaces of or within the longitudinal beams.

19. A liftable carrying apparatus for loading a rail vehicle with cargo by a lifting apparatus, comprising:

a carrying frame having at least two longitudinal beams which extend relative to each other with mutually facing insides and which are connected with each other, wherein the carrying frame has a first support means for the cargo at over at least a part of a length of the at least two longitudinal beams, the first support means configured to be driven on up to a maximum width transversely relative to the at least two longitudinal beams, a receiving location for receiving the lifting apparatus, contact surfaces for direct placement of the carrying apparatus on a terminal floor, and a second support means for cargo, the second support means being arranged at or between arms of a first support device, wherein the arms are arranged outside a drivable width of the first support means for cargo on pivot bearings, wherein a length of the arms is such that the first support means for the cargo in a first pivotal position of the arms is prolonged by the second support means so that the first support means can be driven on and so that the second support means is raised in a second pivotal position of the arms relative to the first support means of the carrying frame, and wherein the pivot bearings of the arms are arranged on the longitudinal beams at an end region, remote from the first support means, of the longitudinal beams.

20. The carrying apparatus as set forth in claim 19, wherein the pivot bearings of the arms are arranged at an upper end region of the longitudinal beams in the vertical direction.

* * * * *